US009025795B2

(12) United States Patent
Adachi

(10) Patent No.: US 9,025,795 B2
(45) Date of Patent: May 5, 2015

(54) OPENING TYPE BONE CONDUCTION EARPHONE

(75) Inventor: Yoshio Adachi, Kodaira (JP)

(73) Assignee: Aue Institute, Ltd., Tokyo (JP)

( * ) Notice: Subject to any disclaimer, the term of this patent is extended or adjusted under 35 U.S.C. 154(b) by 0 days.

(21) Appl. No.: 13/293,322

(22) Filed: Nov. 10, 2011

(65) Prior Publication Data

US 2013/0121513 A1 May 16, 2013

(51) Int. Cl.
*H04R 25/00* (2006.01)
*H04R 11/02* (2006.01)
*H04R 1/10* (2006.01)

(52) U.S. Cl.
CPC ..... *H04R 11/02* (2013.01); *H04R 1/1016* (2013.01); *H04R 2460/13* (2013.01)

(58) Field of Classification Search
USPC ..... 381/162, 334, 370, 380, 395, 412, 413, 381/417, 420, 312–331, 151
See application file for complete search history.

(56) References Cited

U.S. PATENT DOCUMENTS

| | | | | |
|---|---|---|---|---|
| 5,757,935 | A * | 5/1998 | Kang et al. | 381/326 |
| 6,427,018 | B1 * | 7/2002 | Keliiliki | 381/381 |
| 6,807,283 | B2 * | 10/2004 | Masuda et al. | 381/417 |
| 7,302,071 | B2 * | 11/2007 | Schumaier | 381/326 |
| 2006/0077777 | A1 * | 4/2006 | Fried | 369/30.85 |
| 2010/0266154 | A1 * | 10/2010 | Taso | 381/413 |
| 2012/0243726 | A1 * | 9/2012 | Hosoo et al. | 381/380 |

* cited by examiner

*Primary Examiner* — Ahmad F Matar
*Assistant Examiner* — Norman Yu
(74) *Attorney, Agent, or Firm* — Gottlieb, Rackman & Reisman, PC

(57) ABSTRACT

An opening type bone conduction earphone which eliminates headband and has a compact and simple structure comprising a magnetic body, which has an aeration hole, which is able to communicate with the outside world when wearing, at the center part of the axial direction, at least one or more dampers provided at the outer circumference of the magnetic body, and a coil bobbin, which is provided at the outer circumference of the magnetic body, accommodates the damper within a trunk part, and in which a coil is wound at the outer circumference of the trunk part, is provided.

13 Claims, 10 Drawing Sheets

Directions of forces resulting from back current

Directions of forces resulting from positive current

OPENING TYPE BONE CONDUCTION EARPHONE

TECHNICAL FIELD

This invention relates to an opening type bone conduction earphone that is compact and has good wearing feel and ease of use.

BACKGROUND ART

Earphones are broadly divided into earphones that have conventionally existed, which are generally types that are inserted into the external auditory canal and that block the ear, and, separately from this, bone conduction earphones that can be used even if not inserted into the external auditory canal.

Examples of the former earphones are those of Japanese Unexamined Patent Application Publication No. S50-151134 (the magnetic earphone type) and Japanese Unexamined Patent Application Publication No. 2009-111820 (the piezoelectric type).

In addition, an example of the latter earphone is that of Japanese Unexamined Patent Application Publication No. 2009-49844 (the so-called outer bowl type).

In the conventional former earphone, during usage, insertion into the external auditory canal is performed. Therefore, there are problems in that, since the external auditory canal is unfortunately blocked, the external auditory canal is pressed, and when used for a long period of time, discomfort is felt leading to fatigue. Also, there is no air permeability, so perspiration occurs, causing discomfort. Further, the outside world is blocked out, so nervous and physical burdens are felt such as a feeling of isolation, and warning sounds are difficult to hear at times of danger.

On the other hand, with the latter type, usage is performed by bringing about close contact with the head or attaching at the vicinity of the ear without insertion into the external auditory canal. Therefore, the external auditory canal is never pressed as in the former type.

However, the latter type is such that an earphone is provided at both end parts of a hanger portion of a headband comprising an elastic member, and the structure is such that the headband is used by fitting to the head, so the number of components is large, assembly is complicated, and expenses are also considerable. Since the fitting apparatus is both large and heavy, physical strength is required, and the head is pressed in wearing, so there is a feeling of oppression, and it is easy to become tired when wearing for a long period of time. There have been a number of problems such as securing a location when storing.

BRIEF SUMMARY OF THE INVENTION

This invention has been proposed taking the aforementioned items into account, and its purpose is to provide an opening type bone conduction earphone that eliminates the headband and has the compact simple structure of an external auditory canal insertion type while enabling communication with the outside world, providing air permeability and eliminating a sense of pressing when wearing. In addition, this invention provides an opening type bone conduction earphone that makes usage in water possible and that is a type that can be used both on land and in water.

In order to solve the aforementioned problems, the invention as shown in FIG. 1 has a magnetic body, which comprises a long member that has an aeration hole 6' at the center part of the axial direction, which is able to communicate with the outside world when worn, at least one or more dampers 7 provided at the outer circumference of the magnetic body, and a coil bobbin 4, which is provided at the outer circumference of the magnetic body, accommodates the damper 7 within a trunk part, and in which a coil 8 is wound at the outer circumference of the trunk part, and that comprises an opening type bone conduction apparatus 3 interposing the magnetic body that has the aeration hole 6'.

The invention may further comprise an opening type bone conduction earphone in which the magnetic body comprises a movement 6 that has the aeration hole 6' at the center part of the axial direction and that comprises a magnetic material, a structural body of a magnet 5 provided at one end part of this movement 6 or what results from molding a magnetic powder to integrate the movement 6 and the magnet 5.

The invention may further comprise an opening type bone conduction earphone in which the coil bobbin (4) comprises a two-division structure with horizontal divisions or vertical divisions.

The invention may further comprise an opening type bone conduction earphone in which the bone conduction apparatus 3 is covered with a waterproof cover and usage in water is also made possible.

The invention may further comprise an opening type bone conduction earphone in which a waterproof lid-shaped plug that can be freely attached and removed is provided on the aeration hole 6' at the center part of the bone conduction apparatus 3 to make a type that is for use both in water and on land.

According to the opening type bone conduction earphone, there are effects such that the exterior and the tympanic membrane side are caused to communicate by means of the aeration hole 6', and the external auditory canal is never blocked during wearing, so it is possible to alleviate pressing the external auditory canal, and even if perspiration occurs, that moisture is able to escape to the open air, and there is no shielding from the outside world, so it is possible to alleviate feelings of isolation and physical burden, it is possible to sense warning sounds at times of danger, and it is possible to avoid bodily danger.

In addition, there are effects such that usage by the elderly and the hearing impaired is also possible, and even in the case in which usage as a hearing aid is performed, there is no connection between the microphone and speaker, so howling does not occur.

According to the invention, there are effects such that, during assembly, the damper 7 is easily accommodated inside the trunk part of the coil bobbin 4, and ability to assemble is good.

According to the invention usage as a waterproof type is possible, so usage in heavy rain or in water is also possible.

Note that, in those that are a piezoelectric type, due to the rigidity (stiffness control) of the piezoelectric element itself, it is difficult to transmit the bass range. In contrast with this, in the present invention, a movement that includes a magnet has mass (mass control), so there is an advantage in that it is easy to transmit vibration directly to bones.

DETAILED DESCRIPTION OF THE INVENTION

Embodiment 1

Figure 1:
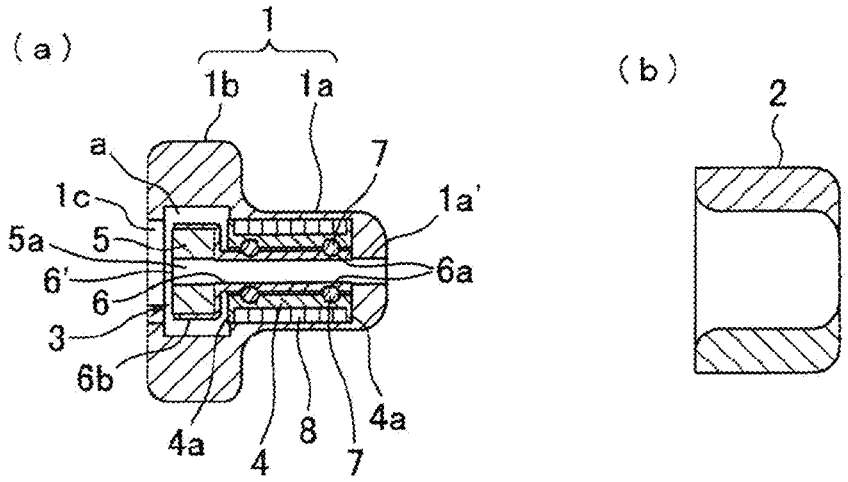
FIG. 1(*a*) is a cross-sectional view of the first embodiment of the present invention, and (*b*) is a cross-sectional view of an example of a cover that is to be combined.

FIG. 1(*a*) shows a vertical cross-sectional diagram of an opening type relating to the first embodiment of the present invention.

1 in the drawing is a housing comprising an elastic member such as silicone rubber or elastomer, this housing 1 comprises a cylindrical part 1*a*, which is inserted into the external auditory canal and forms a nearly cylindrical shape, and a flange part 1*b*, which is formed at the outer circumference of one of the outer end parts of this cylindrical part 1*a*, has a prescribed thickness, and is nearly disk shaped. In usage, the cylindrical part 1*a* is inserted into the external auditory canal, and the flange part 1*b* is also similarly inserted into the external auditory canal. In addition, a material and hardness that have good vibration conduction efficiency are selected for the material of the housing.

A pad 2 with a nearly cylindrical shape is placed on the outer circumference part of the cylindrical part 1*a* as shown in FIG. 1(*b*). This pad 2 comprises a soft elastic material, and the shape of the external auditory canal varies according to the person, so when the bone conduction earphone is inserted into the external auditory canal, the pad portion acts so as to deform and closely adhere. The flange part 1*b* also comprises a deformable elastic material. Note that the cylindrical part 1*a* and the pad 2 may also of course be formed as a unit.

Provided at the hollow parts of the interior of the cylindrical part 1*a* and the flange part 1*b* is an opening type bone conduction apparatus 3, which is a transducer (electromechanical conversion unit) and is the principal member of the present invention.

The bone conduction apparatus 3 is configured by comprising a movement 6 that forms a cylindrical shape, which has a magnet support part 6*b*, on which is formed a long cylindrical main body on which at least one or more grooves 6*a* are formed at the outer circumference part, which is formed as a unit at one end part of this main body, is wider in diameter than the main body cylindrical part and in which a space for accommodation is formed at the interior, is capable of vibration and comprises a magnetic material, a magnetic body that comprises a ring shaped magnet 5 accommodated in the interior of the magnet support part 6*b* of this movement 6, dampers 7, which comprise an elastic member such as rubber provided in the grooves 6*a* of the movement 6 that comprises this magnetic body, a coil bobbin 4, which has a groove for the damper accommodation at the inner circumference surface and is provided in a noncontact status separated from the main body cylindrical part via the dampers 7, and a coil 8, which is wound between flanges 4*a* formed at both ends of this coil bobbin 4. Note that the magnet support part 6*b* need not be a cylindrical shape such as that shown in the illustrated example and may also be, for example, disk shaped for another appropriate shape.

This main body cylindrical part of the movement 6 and the dampers 7 are positioned within a space of a hollow trunk part of the coil bobbin 4.

In the above, the magnet 5 is provided within the magnet support part 6*b* of the movement 6 using a bonding agent or by means of a fixing means such as caulking. In addition, the hole 5*a* of the center part of the magnet 5 and the hole in the interior of the main body cylindrical part of the movement 6 may communicate forming a coaxial shape and may also communicate forming a coaxial shape respect to a hole 1*a*' formed at the center part of the inner end part side of the cylindrical part 1*a* of the housing 1 (in the case in which it has been inserted into the external auditory canal, a portion positioned at the tympanic membrane side).

The magnet 5 is provided within a space a formed in the flange 1*b*, and the magnet support part 6*b* is not in contact with the inner surface of the flange part 1*b* so as not to obstruct vibration of the movement 6. In addition, the inner circumference surface sides of the dampers 7 are positioned in the grooves 6*a* of the movement 6, the outer circumference surface sides of the dampers 7 are positioned at the inner circumference surface side of the drum part of the coil bobbin 4, and a space is provided between the coil bobbin 4 and the main body cylindrical part of the movement 6 so that the movement 6 can easily vibrate. It is preferable that this movement 6 use a material with high magnetic permeability.

Note that the movement 6 and the magnet 5 that comprise a magnetic material such as iron or stainless have separate structures in the illustrated embodiment, but it may also be a magnetic body in which, for example, hexagonal ferrite magnetic powder or an alloy powder such as stainless steel powder for sintering is molded and integrated.

In addition, in FIG. 1, symbol 1*c* is an opening part formed at the outer side of the flange part 1*b*.

Figure 2:
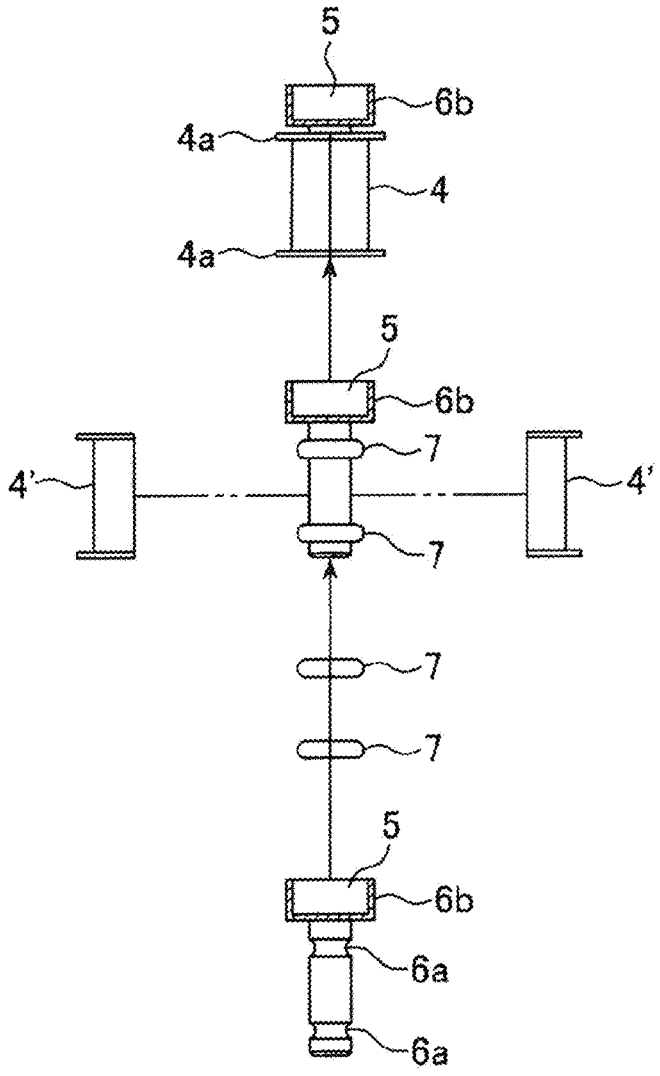
FIG. 2 shows an example of the assembly procedure of a bone conduction apparatus relating to the present invention.

FIG. 2 is an explanatory view that shows an example of assembly of the opening type bone conduction apparatus 3.

In assembly, as shown in the lower side drawing, the magnet 5 is set at the magnet support part 6*b* of a movement 6 that forms a long, thin nearly cylindrical shape. In the illustrated example, the magnet support part 6*b* portion is shown in cross-section so that the installed status of the magnet 6 can be easily understood. In addition, as shown in the center of the drawing, dampers 7 are installed, for example, in paired grooves 6*a*, a pair of coil bobbin halves 4' with a two-division structure of preferably the horizontal division type are respectively arranged in opposition, the outer circumference parts of the dampers 7 are accommodated in the interior from both sides, the junction parts of the coil bobbin halves 4' are integrated preferably by ultrasonic welding, and as shown at the very top of the drawing, a coil bobbin 4 is formed. By making the coil bobbin 4 into a horizontal division two-division structure in this way, it is possible to make a structure in which, for example, the dampers 7 can be easily built into the interior, and to give the item excellent assemblability. Note that, the coil bobbin 4 was made a left-right horizontal division type in the illustrated status, but it may also be made a two-division vertical division structure. Note that, the magnet 5 may also be incorporated in the final process and may be incorporated at any stage. In addition, the magnet support part 6*b*, as described above, need not be cylindrical and may have a disk shape or other shape.

Figure 3:
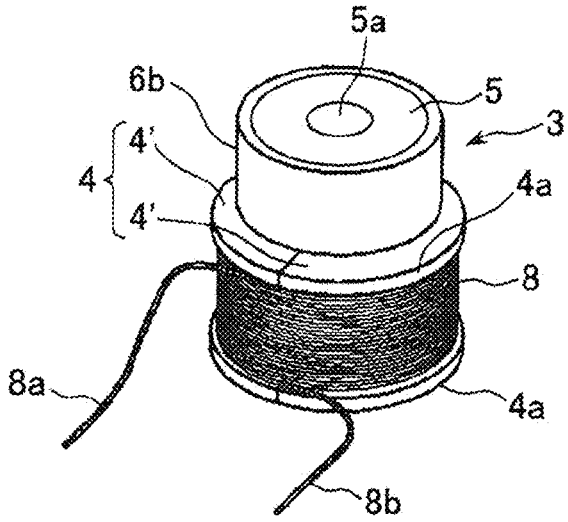
FIG. 3 shows a perspective view of completion of assembly of a bone conduction apparatus relating to the present invention.

A coil 8 is wound at the outer circumference of the trunk part of the coil bobbin 4 as shown in FIG. 3, and the open type bone conduction apparatus 3 shown in FIG. 1(*a*) is completed. Note that, in FIGS. 3, 8*a* and 8*b* are lead lines of the coil 8 for audio signal conduction.

This bone conduction apparatus 3, as shown in FIG. 1(*a*), is provided by the insertion method or the charging method at the interior of the hollow part of the housing 1. In this case, the magnet 5 is positioned at the outside (within the flange part 1*b* of the housing 1). The insertion method is a method in which there is literally insertion into the center part of the housing 1 or in which there is fixing by means of a bonding agent. The charging method is similar.

Figure 4:
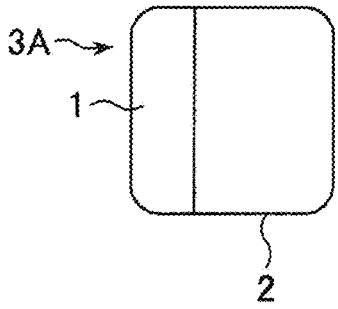
FIG. 4 shows an explanatory drawing of the completed status of an opening type bone conduction earphone of the present invention.

FIG. 4 is an explanatory view of an assembled opening type bone conduction earphone 3A as seen from the side surface. The level difference between the outer circumference surface of the flange part 1*b* and the outer circumference surface of the pad 2 is slight or there is no level difference, and a portion of the flange part 1*b* is also inserted into the external auditory canal when using. However, through this bone conduction earphone, when the pad 2 portion, which is the ear insertion part, has been inserted into the external auditory canal, the external auditory canal never becomes blocked due to the hole of the center part of the magnet, the aeration hole 6' of the movement 6, and the hole 1*a*' of the housing 1.

Figure 5:
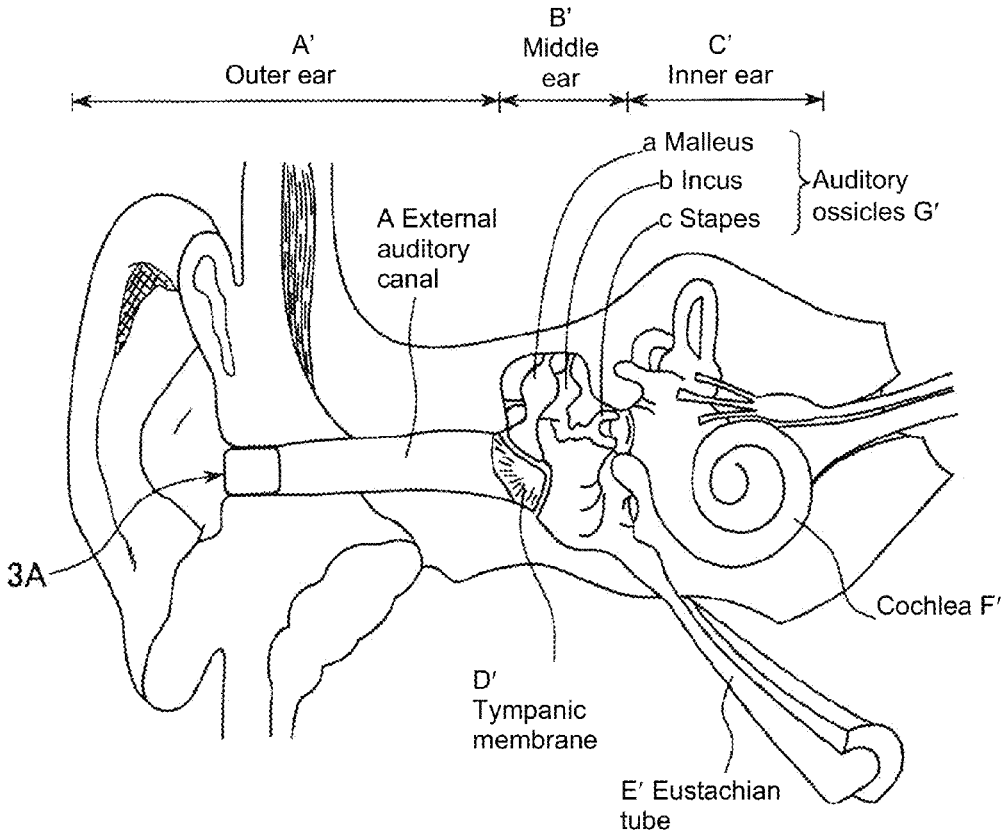
FIG. 5 shows an opening type bone conduction earphone of a first embodiment of the present invention that has been fit into an ear.

In usage, as shown in FIG. 5, the opening type bone conduction earphone 3A is completely inserted into the external auditory canal A. In addition, an audio current is conducted in a coil 8 of the opening type bone conduction apparatus via the lead lines 8*a* and 8*b* (see FIG. 3, not shown in FIG. 5 for convenience of illustration). FIG. 5 shows the structures of the outer ear A', the middle ear B', and the inner ear C'. In addition, D' is the tympanic membrane, E' is the Eustachian tube, F' is the cochlea, and G' is the auditory ossicles, which are the malleus a, the incus b and the stapes c.

Figure 6:
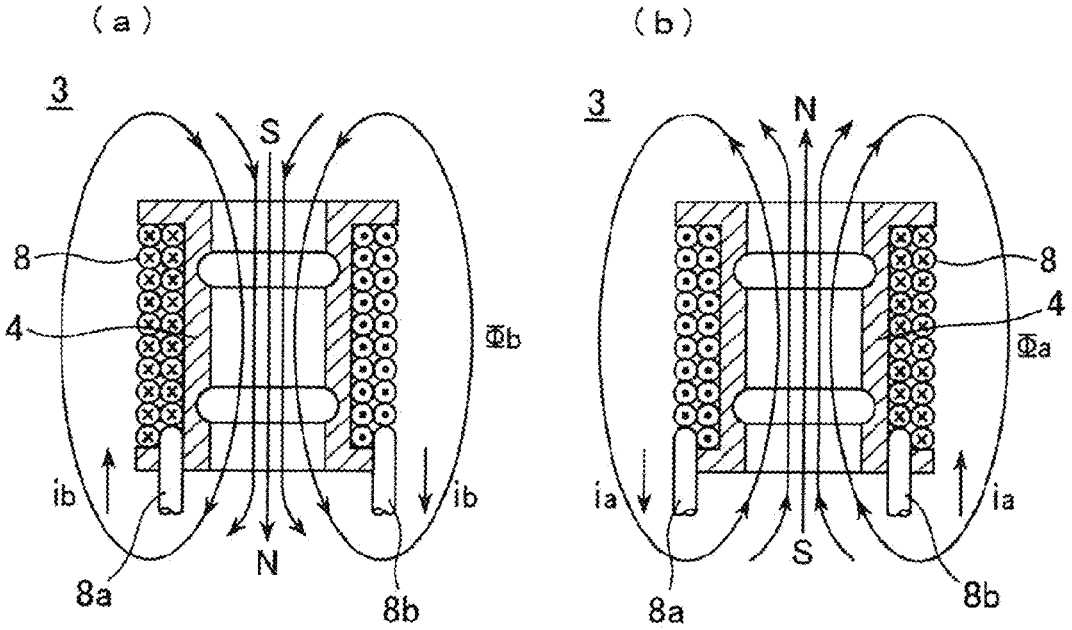
FIGS. 6(*a*) and (*b*) show explanatory drawings of the currents that flow in the coil and the generated magnetic fields.
Figure 7:
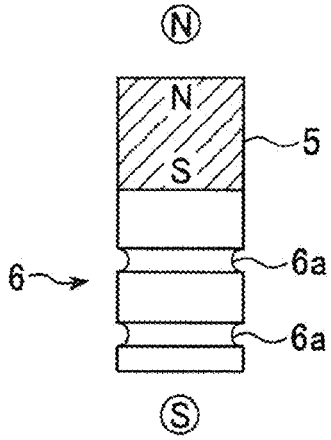
FIG. 7 shows an explanatory drawing that shows an example of a magnetic body comprising a movement and a magnet.
Figure 8:
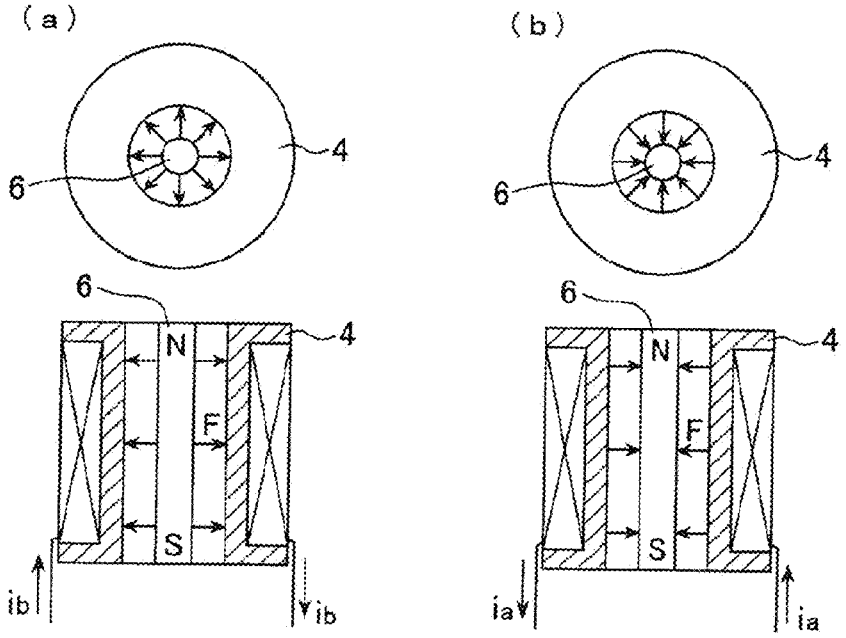
FIGS. 8(*a*) and (*b*) are forces (F) produced by the magnetic body due to the generated magnetic fields.
Figure 9:
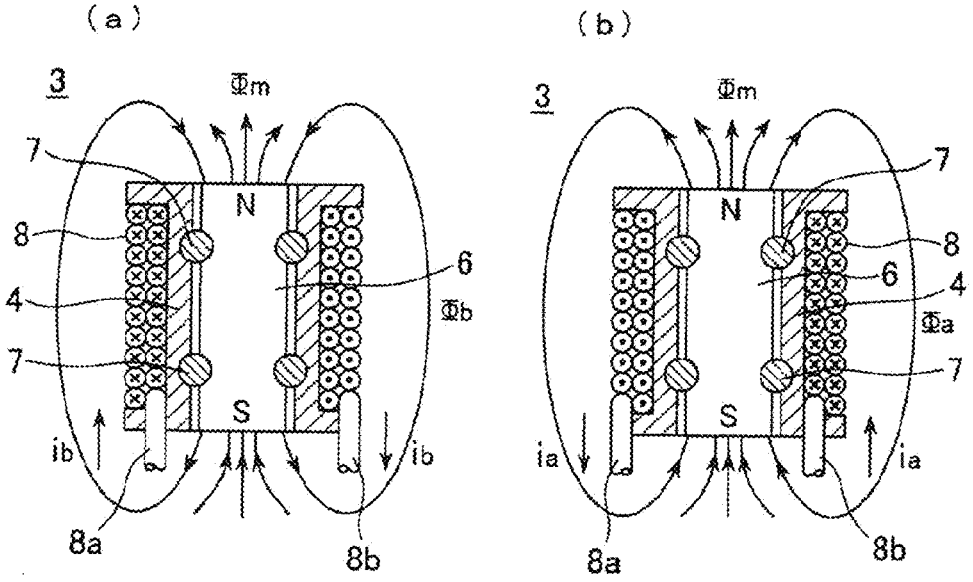
FIGS. 9(*a*) and (*b*) show the relationship between the current that flows in the coil, magnetic fields Φa and Φb, and the magnetic field Φm of the magnet.

FIGS. 6(*a*) and (*b*) through FIGS. 9(*a*) and (*b*) show the principles of vibration of the bone conduction apparatus 3. FIGS. 6(*a*) and (*b*) are explanatory drawings of the electric currents that flow in the coil 8 and the magnetic fields Φa, Φb generated thereby. FIG. 7 is an example of a magnetic body, FIGS. 8(*a*) and 8(*b*) are explanatory drawings in which an F resulting from the generated magnetic fields act on the magnetic body, and FIGS. 9(*a*) and (*b*) show the relationship between the generated magnetic fields Φa, Φb, and the magnetic field Φm of the magnet.

Specifically, in FIGS. 6(*a*) and (*b*), when an alternating audio current flows in the coil 8 via the lead lines 8*a*, 8*b*, the directions of the generated magnetic fields Φa, Φb alternately change as shown by the arrows in accordance with the directions of those electric currents ia, ib according to Ampere's right-hand rule. Ampere's right-hand rule is a rule that indicates the relationship between an electric current and a magnetic field formed around it, and when current flows, the direction of the current is the direction in which a right-hand proceeds, and a magnetic field is generated oriented around the right-hand. Note that 4 in the drawing is the coil bobbin, 6 is the movement, and 7 is the damper. The movement 6 of this example is made a magnetic body with a configuration in which the magnet 5 is provided at one end part as illustrated.

When a movement 6 of a material with high magnetic permeability that has a magnet 5 at one end part is arranged at the center of the coil 8 as shown in FIG. 7, forces F generated according to Fleming's left hand rule are received. As shown in FIGS. 8(*a*) and (*b*), these forces F work in directions that support the movement 6 arranged at the hollow part of the coil bobbin 4 via an interval by means of the damper 7. The arrows indicate the directions of the forces generated according to the directions of the electric currents ia, ib.

As shown in FIGS. 9(*a*) and (*b*), a magnetic body comprising a movement 6 into which a magnet 5 has been integrated is mechanically supported by the dampers 7, so by means of an audio signal, the generated magnetic fields Φa, Φb affect the magnetic flux Φm of the magnet 5 and bring about vertical movement of the magnetic body. This vibration is transmitted to the coil bobbin 4, is transmitted to the bones via a member that covers the vibrating body itself, and is transmitted to the auditory nerve. In this case, the member that covers the vibrating body is similar in hardness to the external auditory canal, and adhesion with the charging periphery is emphasized. Note that the holding dampers 7 may also be a single unit if balance of the movement 6 can be achieved. In addition, the dampers 7 should be such that the hardness is low so as to immediately cause the movement 6 to vibrate.

The bone conduction apparatus 3, which functions as a vibrating body and comprises the magnet 5, the movement 6, the dampers 7, the coil bobbin 4 and the coil 8, is provided inside the housing 1, and vibration is transmitted to the housing 1.

Common air passage sounds are such that sound is transmitted through the air as vibration, the tympanic membrane vibrates, and transmission to an auditory organ called the cochlea is performed. In contrast with this, in the present invention, vibration of the bone conduction apparatus 3, in FIG. 5, is directly transmitted from the auditory ossicles G' to the auditory nerve beyond the cochlea F' and is recognized in the brain

Embodiment 2

Figure 10:
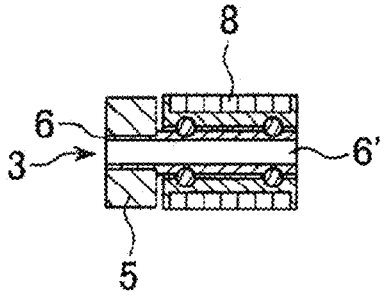
FIG. 10 shows a cross-sectional view of a second embodiment of the bone conduction earphone of the present invention.
Figure 11:
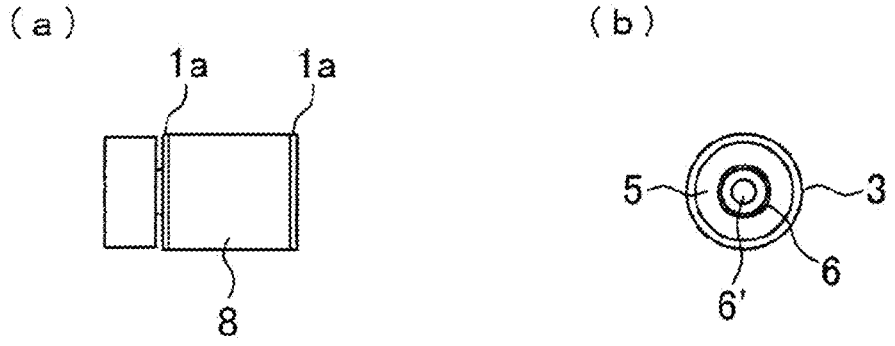
FIG. 11(*a*) shows an explanatory view in which a completed status of the second embodiment of the bone conduction earphone of the present invention is seen from the side surface, and (*b*) shows a front view.

FIG. 10 shows a cross-sectional view of a second embodiment of the present invention. This embodiment is characterized in that the entire outer shape has been made somewhat long and nearly cylindrical in the axial direction. FIG. 11(*a*) is an explanatory view that shows the external appearance, and (*b*) is a front view.

In this embodiment, the shape of the movement 6 is made simple. Specifically, it is characterized in that the opening type bone conduction apparatus 3 is comprised by making the movement 6 long and thin and cylindrical and installing a ring shaped magnet 5 at the outer circumference of one end part thereof (in the case in which insertion into the external auditory canal has been performed, corresponding to the outside position of the external auditory canal). In this example, one end part of the movement 6 functions as the support part of the magnet 5.

Embodiment 3

Figure 12:
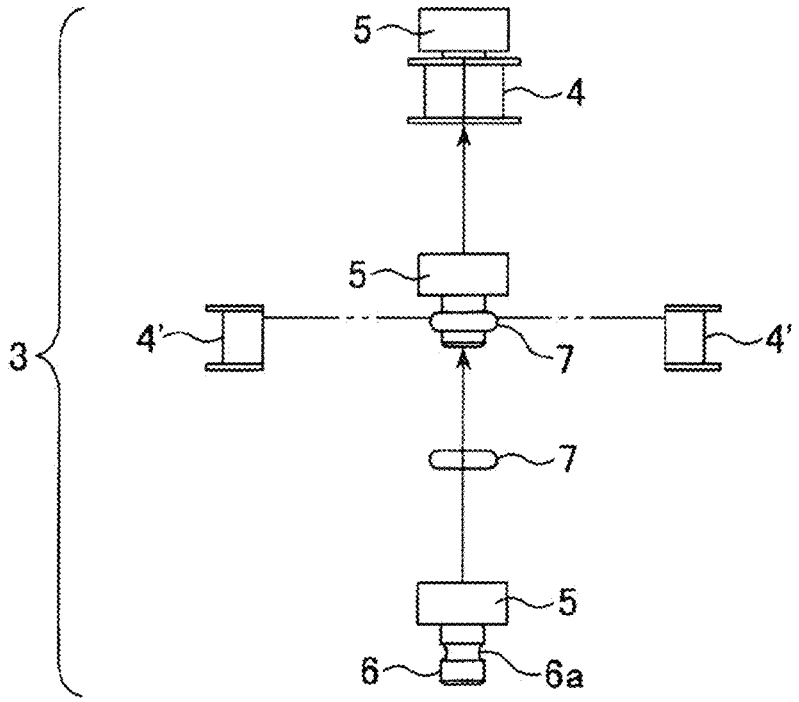
FIG. 12 shows an example of the assembly procedure for a third embodiment of the bone conduction earphone of the present invention.

FIG. 12 shows another example of a bone conduction apparatus 3. In this third embodiment, the magnet 5 is installed at the end part of the movement 6, one damper 7 and groove 6*a* are used, and the dimensions of the movement 6 and the coil bobbin 4 in the axial direction are made short, and otherwise it has nearly the same basic configuration as the previously discussed bone conduction apparatus 3, so repeating an explanation is not necessary.

Figure 13:
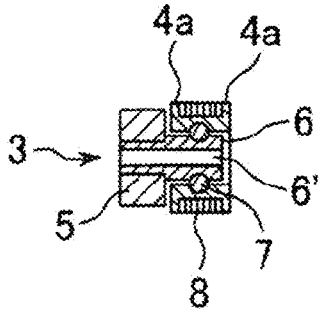
FIG. 13 shows a cross-sectional view of a completed status of the third embodiment of the bone conduction earphone of the present invention.

FIG. 13 shows a cross-sectional view of the assembled status.

Figure 14:
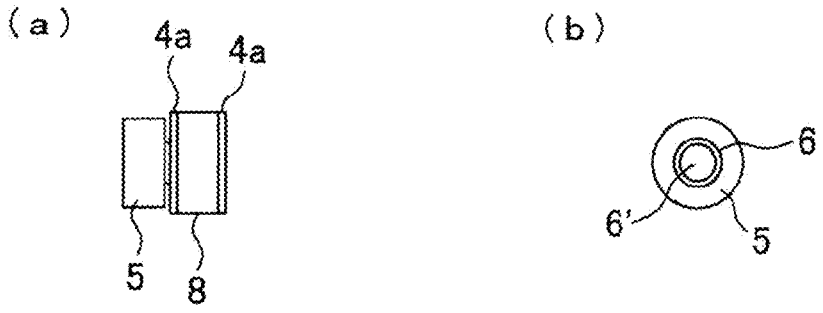
FIG. 14(*a*) shows an explanatory view in which a completed status of the third embodiment of the bone conduction earphone of the present invention is seen from the side surface, and (*b*) shows a front view.

FIG. 14(*a*) is an explanatory drawing of the completed status, and (*b*) is a front view.

Embodiment 4

Figure 15:
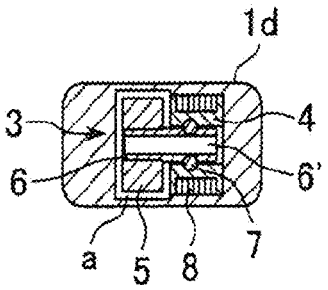
FIG. 15 shows a side cross-sectional view of a fourth embodiment of the bone conduction earphone of the present invention.
Figure 16:
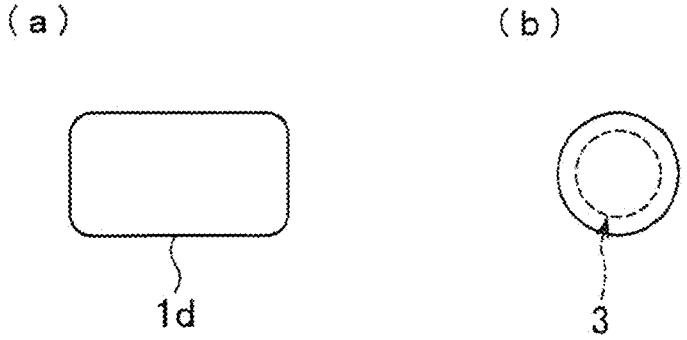
FIG. 16(*a*) shows an explanatory view in which a completed status of the fourth embodiment is seen from the side surface, and (*b*) shows a front view.

FIG. 15 shows a fourth embodiment of the present invention. In this embodiment, the basic configuration of the bone conduction apparatus 3 is similar to that of FIG. 10. FIG. 16(*a*) is an external side surface view thereof, and (*b*) is a front view.

What characterizes this embodiment is that the bone conduction earphone is an ear plugging type, and the bone conduction apparatus 3 to be inserted into the external auditory canal is covered by a cover 1*d* comprising an elastic material that is waterproof to make usage in the water possible. In this case, there is an interval between the outer circumference of the magnet 5 and the inner surface of the waterproof cover 1*d* such that vibration is not hindered.

In this embodiment, the damper 7 is a single type, but as in the embodiment shown in FIG. 1, it is of course possible to use a bone conduction apparatus in which the damper 7 is made a double type.

In addition, it goes without saying that the shape of the cover 1*d* is not limited to the illustrated example. In addition, in the case in which, instead of the cover 1*d*, a waterproof lid shaped plug (not shown) that prevents the penetration of water into the interior is made attachable to and removable from the interior of the aeration hole 6' of the center part of the bone conduction apparatus 3 in the axial direction and a plug that is nearly columnar or the shape of a cylinder with a bottom is inserted, usage in water is made possible, and in the case in which the plug is removed, the aeration hole 6' communicates with the outside air, usage on land is made possible, and it may be made a type that is used on both land and water.

Figure 17:
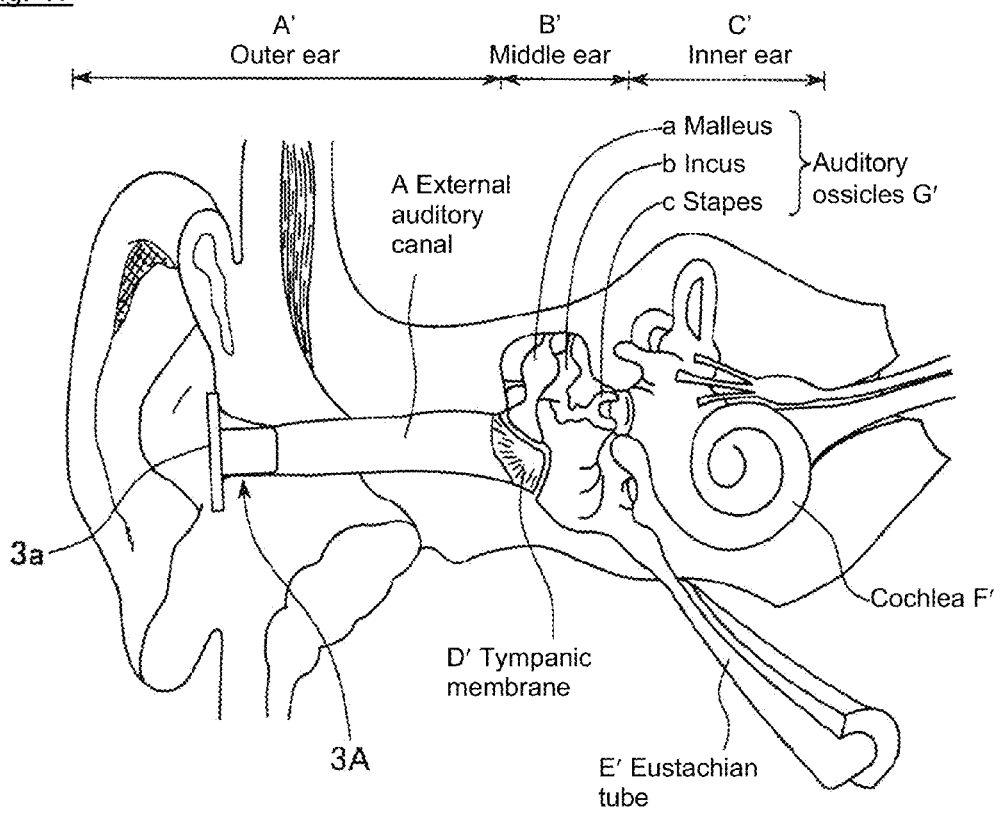
FIG. 17 is a fifth embodiment of the bone conduction earphone of the present invention and shows a status in which fitting into the ear has been performed.

FIG. 17 shows a fifth embodiment of the present invention. This embodiment is characterized in that a flange 3*a* that is positioned at the outside of the external auditory canal A is provided at the outside of the opening type bone conduction earphone 3A, and, for example, an appropriate illustration may implemented or precious stones may be provided at the outer surface of this flange 3*a* to give an accessory effect. The outer shape of the flange 3*a* is circular and may also be polygonal or rectangular. Attachment to the bone conduction apparatus 3A is performed by means of, for example, a fitting means that results from a bonding agent, ultrasonic welding, or a concavoconvex structure. Through the fitting means, free attachment and removal are made possible, and usage as shown in FIG. 5 is made possible. Note that, it is preferable that a hole that communicates with the aeration hole 6' be opened at the center part of the flange 3*a*. The hole may be covered with a member such as a cloth that has air permeability.

DESCRIPTION OF SYMBOLS

1 Housing
1*a* Cylindrical part
1*a'* Hole
1*b* Flange part
1*c* Flange opening part
2 Pad
3 Bone conduction apparatus
3A Opening type bone conduction earphone
3*a* Flange that provides a decorative effect
4 Coil bobbin
4*a* Flange
5 Magnet
5*a* Magnet opening
6 Movement
6*a* Groove
6*b* Magnet support part
6' Aeration hole
7 Damper

The invention claimed is:

1. A bone conduction apparatus for communicating with an outside world, comprising:

an axially extending magnetic body including an outer circumference and an aeration opening extending centrally through the magnetic body that is adapted to allow outside air to permeate into an external auditory canal at all times;

a damper provided at the outer circumference of the magnetic body;

a coil bobbin comprising a trunk part and having an outer circumference extending about the outer circumference of the magnetic body with said damper interposed between said magnetic body and said trunk part of said coil bobbin; and a coil wound about the outer circumference of the trunk part of the coil bobbin.

2. The bone conduction apparatus according to claim 1, wherein the magnetic body includes a magnetic material affixed to a structural body located at a proximal end of the magnetic body, the structural body including an aeration hole extending centrally through the structural body and that is substantially concentric with the aeration opening of the magnetic body.

3. The bone conduction apparatus according to claim 2, wherein the magnetic material is a molded magnetic powder from a hexagonal ferrite magnetic powder or an alloy powder for integrating the structural body and the magnet.

4. The bone conduction apparatus according to claim 1, wherein the coil bobbin is a two-division structure with horizontal divisions or vertical divisions.

5. The bone conduction apparatus according to claim 1, further comprising a waterproof cover encompassing the bone conduction apparatus.

6. The bone conduction apparatus according to claim 1, further comprising a waterproof lid-shaped stopper that is selectively attachable to the aeration hole of the magnetic body such that the bone conduction apparatus is adaptable between use in water and on land and to prevent water from permeating the external auditory canal of an ear through the aeration opening.

7. The bone conduction apparatus according to claim 5, further comprising an interval between the outer circumference of the magnetic body and the waterproof cover.

8. The bone conduction apparatus according to claim 1, further comprising a housing that includes a cylindrical part encompassing the bone conduction apparatus and a pad with a cylindrical shape configured to be placed on an outer circumference of the cylindrical part of the housing.

9. The bone conduction apparatus according to claim 8, wherein the pad comprises of a soft elastic material to allow for deformation and adherence to the external auditory canal.

10. The bone conduction apparatus according to claim 9, wherein the cylindrical part of the housing and the pad are formed as a unit.

11. The bone conduction apparatus according to claim 1, wherein the aeration hole allows air into the external auditory canal when perspiration is present.

12. The bone conduction apparatus according to claim 3, wherein the alloy powder is a stainless steel powder.

13. A bone conduction apparatus for communicating with an outside world, comprising:

an axially extending magnetic body including an outer circumference and an aeration opening extending centrally through the magnetic body that is adapted to allow outside air to permeate into an external auditory canal at all times;

a damper provided at the outer circumference of the magnetic body;

a coil bobbin, comprising a trunk part and having an outer circumference, extending about the outer circumference of the magnetic body with said damper interposed between said magnetic body and said trunk part of said coil bobbin;

a coil wound about the outer circumference of the trunk part of the coil bobbin; and a waterproof lid-shaped stopper selectively attachable to the aeration hole of the magnetic body such that the bone conduction apparatus is adaptable between use in water and on land and to prevent water from permeating an external auditory canal of an ear through the aeration opening.

* * * * *